US011243041B2

(12) United States Patent
Mullins

(10) Patent No.: US 11,243,041 B2
(45) Date of Patent: Feb. 8, 2022

(54) GUN HANGER

(71) Applicant: Matthew Mullins, Montrose, IA (US)

(72) Inventor: Matthew Mullins, Montrose, IA (US)

( * ) Notice: Subject to any disclaimer, the term of this patent is extended or adjusted under 35 U.S.C. 154(b) by 0 days.

(21) Appl. No.: 17/116,507

(22) Filed: Dec. 9, 2020

(65) Prior Publication Data

US 2021/0172696 A1 Jun. 10, 2021

Related U.S. Application Data

(60) Provisional application No. 63/104,804, filed on Oct. 23, 2020, provisional application No. 62/946,161, filed on Dec. 10, 2019.

(51) Int. Cl.
*F41A 23/18* (2006.01)

(52) U.S. Cl.
CPC ..... *F41A 23/18* (2013.01)

(58) Field of Classification Search
CPC ..... F41A 23/18; F41A 23/20
USPC ..... 42/94
See application file for complete search history.

(56) References Cited

U.S. PATENT DOCUMENTS 3,045,832 A 7/1962 Hibbard
3,556,454 A 1/1971 Korn, Sr. et al.
5,303,859 A * 4/1994 Jenkin ..... F41C 23/02 224/149
6,029,386 A * 2/2000 Globig ..... F41A 23/18 211/64
6,419,097 B1 * 7/2002 Anderson ..... F41A 23/18 211/85.7
7,604,420 B2 10/2009 Moody et al.
7,797,872 B1 * 9/2010 Lynch ..... F41A 21/08 42/77
9,052,157 B1 * 6/2015 Montes ..... F41C 23/02
10,228,216 B2 * 3/2019 Reeves ..... F41C 33/007
2010/0287808 A1 * 11/2010 King ..... F41C 23/02 42/85
2012/0030986 A1 * 2/2012 Swan ..... F41C 33/007 42/85

* cited by examiner

*Primary Examiner* — Joshua E Freeman
(74) *Attorney, Agent, or Firm* — Lane & Waterman LLP

(57) ABSTRACT

A gun hanger for vertically hanging a firearm is disclosed. The gun hanger allows an operator to hang the firearm in a vertical position to enable the operator to use both hands for other tasks, such as climbing over a fence or climbing a tree, thus increasing firearm safety. In one embodiment, the gun hanger comprises an L-shaped member and a flat plate member. The flat plate member has a recess sized to accept the magazine of a firearm and secure the gun hanger to the firearm with the magazine cap. The recess can be sized to accept different firearms such as 12 gauge and 20 gauge shotguns. The L-shaped member can be mounted on many surfaces such as fences, tree branches, and boat sides to keep the firearm in a vertical position. Methods for using the gun hanger are also disclosed.

17 Claims, 7 Drawing Sheets

GUN HANGER

PRIORITY

This application claims priority to U.S. provisional patent applications Ser. No. 62/946,161, filed Dec. 10, 2019, and Ser. No. 63/104,804 filed Oct. 23, 2020, which are incorporated herein by reference.

BACKGROUND

Gun accidents happen reliably every year. This is especially true of hunting accidents. Part of the reason for these accidents is that users lean guns against various supports or lay them down when they are not carrying them. The guns can be knocked over and discharge. Generally supporting a gun vertically is safer than support horizontally. There are many situations where it would be advantageous to have a portable way to vertically securely hang a firearm, i.e. off of tree branches, fences, boats, no available rack, etc. Thus, there is a need for a truly portable vertical gun hanger which occupies a minimum amount of space and which can easily be attached to and removed from the gun.

SUMMARY

A gun hanger including features capable of connecting to a firearm magazine to hang a firearm vertically on a support is disclosed. In one embodiment, the gun hanger has an L-shaped member releasable connected to a flat plate. The gun hanger can be releasably connected to the firearm by screwing the gun hanger on the firearm magazine with the magazine cap. The gun hanger can then be placed on a support to hold the firearm vertically.

The gun hanger has a recess capable of allowing the hanger to be secured to the firearm magazine by the firearm magazine cap. In one embodiment, the size of the recess fits a 12 gauge shotgun magazine. In another embodiment, the size of the recess fits a 20 gauge shotgun magazine. In yet another embodiment, the size of the recess fits a swing swivel on a gun magazine cap.

In other embodiments, methods of hanging a firearm vertically and safely handling a firearm by using the gun hanger are contemplated.

BRIEF DESCRIPTION OF THE DRAWINGS

These and other attributes of the present disclosure will become more apparent upon reference to the following specification and drawings wherein.

DETAILED DESCRIPTION

Figure 1:
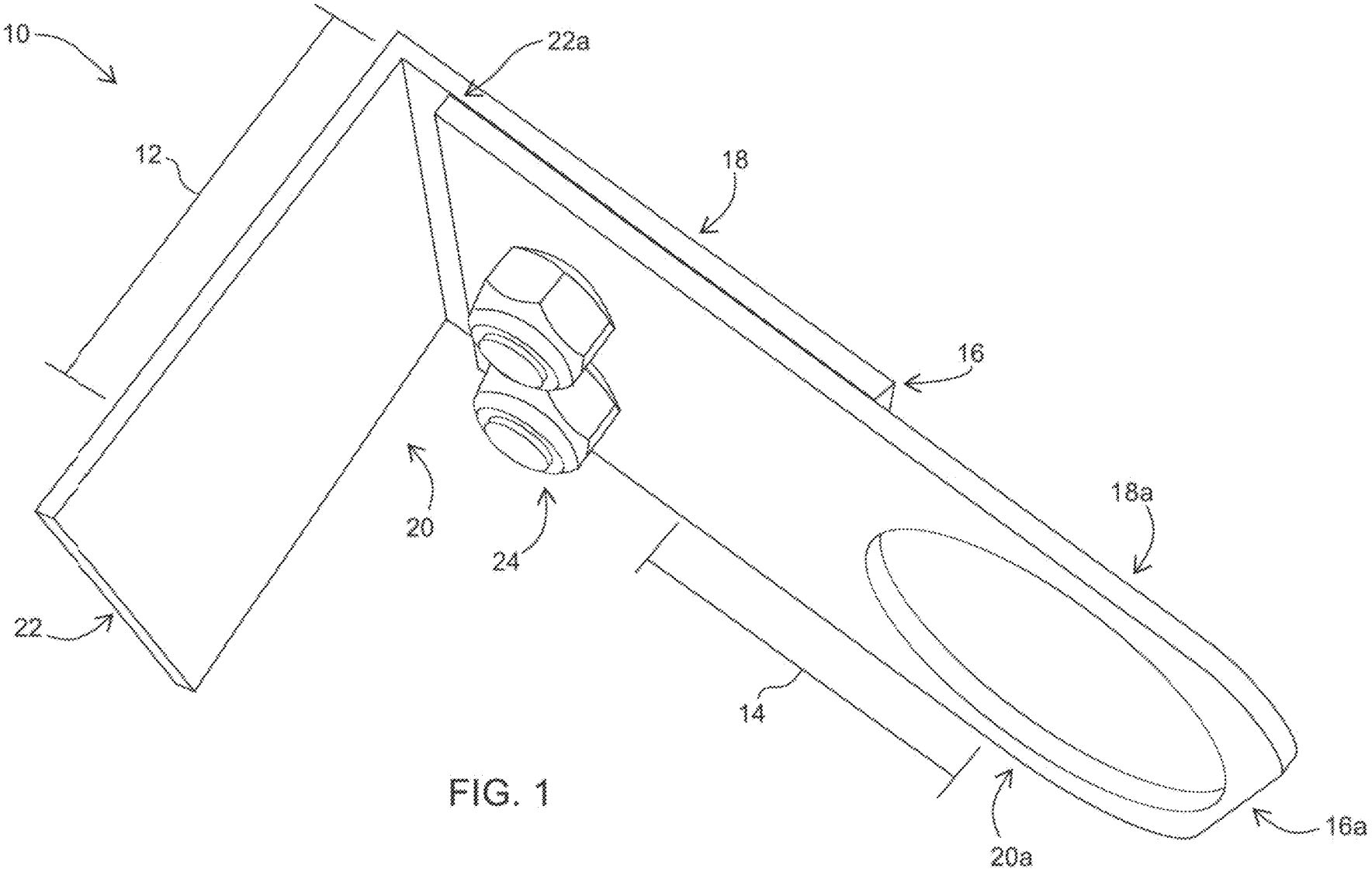
FIG. 1 is a perspective view of a gun hanger.

Referring now to the drawings, there is illustrated in FIG. 1 a gun hanger generally designated by the reference number

10, in one embodiment, gun hanger 10 comprises an L-shape member comprised of two members (12, 14) where one member is L-shaped 12 and the second member is a flat plate 14. Each member of gun hanger 10 has a top 16/16*a*, a top side 18/18*a*, a bottom side 20/20*a* and a bottom 22/22*a*. In the example of FIG. 1, the two members of gun hanger 10 are engaged at top 16 of L-shaped member 12 and bottom 22*a* of flat plate 14 by fasteners, such as nuts 24 and screws (not shown). In one form, such as the one of FIG. 1, the members are fastened by two fasteners. In other embodiments, the number of fasteners will be 4, 6, 8, or the like. In certain embodiments, the fastener can be adjusted by a choke tube tool. Self-tapping screws are also contemplated as are normal screws such as Philips head screws. Nuts 24 may be nylon or some other appropriate material. In some embodiments, nuts 24 are permanently attached, through welding for example, to one of the members. As is understood, if nuts 24 are permanently attached, it does not matter to which member the nuts are permanently attached. L-shaped member 12 or flat plate member 14 may be connected with either L-shaped member 12 or flat plate 14 above the other at connection point 26. In another embodiment, gun hanger 10 is one member and formed from stainless steel.

Figure 2:
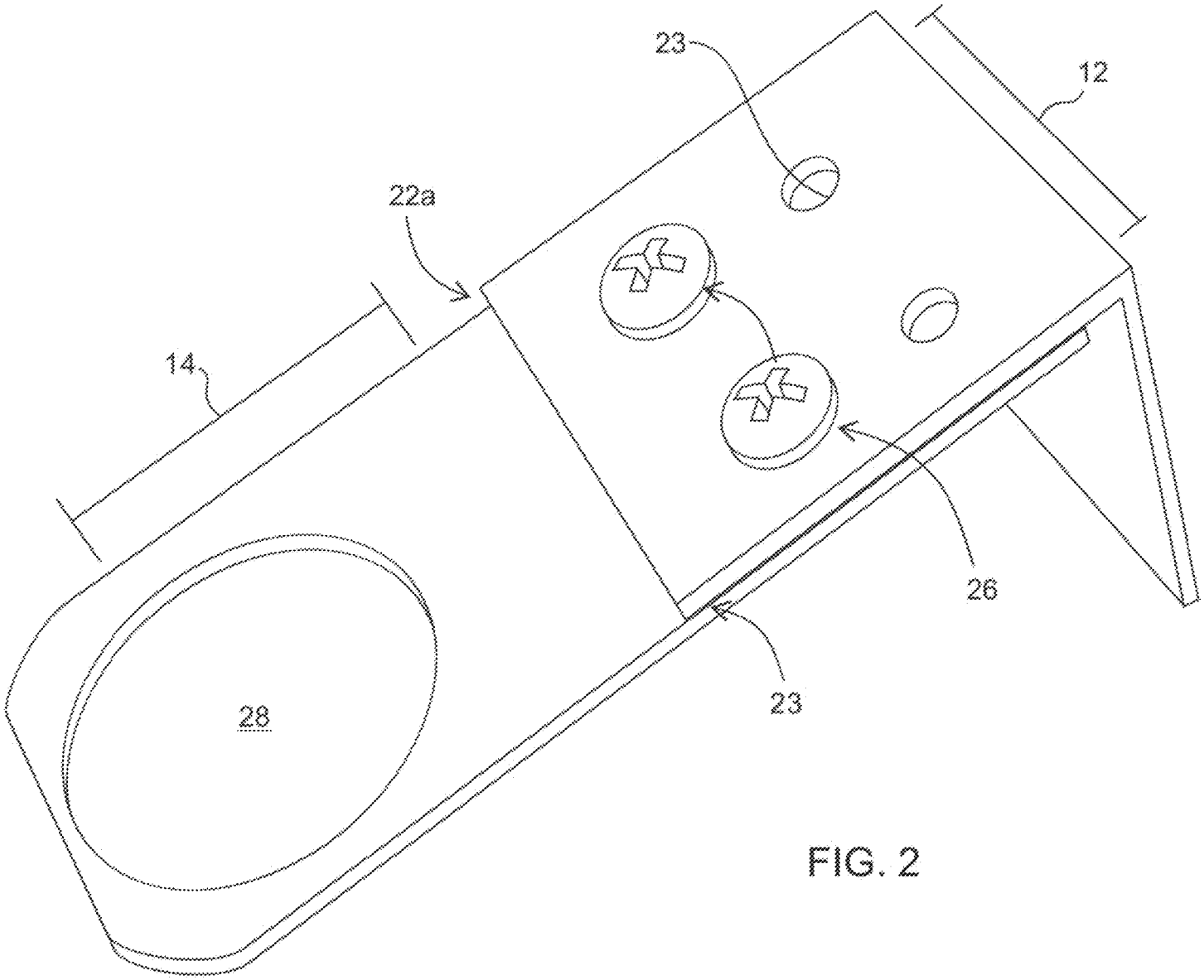
FIG. 2 is an alternative perspective view demonstrating the gun hanger as extended.

Either L-shaped member 12 or flat plate member 14 may have additional openings 23 for fasteners, such as that demonstrated in FIG. 2. These additional openings allow for the overall length of gun hanger 10 on the side of flat plate 14 to be extended in certain embodiments. This can be advantageous in the event where the gun will be hung from something with a larger width, such as commonly found 2"×4" pieces of lumber.

In all embodiments, flat plate 14 has a round recess opening 28 where the recess opening 28 has a diameter sufficient to receive the magazine of a firearm such as a shotgun. For example, the diameter of recess opening 28 may be 1⅛ inches. This size generally fits a 12 gauge shotgun. In another embodiment, recess opening 28 has a diameter of ¾ inches. This size generally fits a 20 gauge shotgun. Although as is known by the skilled artisan, shotgun magazines do not have standard sizes. Therefore, recess opening 28 can be any size among a continuum between ¾ inches and 1⅛ inches. Recess opening 28 must be large enough but not too large to not only receive the magazine of a firearm but also to allow a magazine cap or other fastener to extend through recess opening 28 and fully tighten gun hanger 10 down against a firearm magazine. If a magazine cap is used to secure gun hanger 10, the type of cap is not limiting and must only be the right cap for the particular gun to allow gun hanger 10 to be secured without looseness. Toothed lock washers may additionally be used with the magazine cap. Recess opening 28 will generally be closer top 16*a* of flat plate 14 than to bottom 22*a*. In certain embodiments, instead of being smooth, recess opening 28 will be notched. This notching can be on the top of recess opening 28 or the bottom of recess opening 28 or completely around recess opening 28. If the gun hanger is to be used with a recessed magazine cap, recess opening 28 will be ¼ inch to 5/16 inch instead of the larger recess. This smaller hole will allow for connection with a swing swivel (not shown).

Figure 1B:
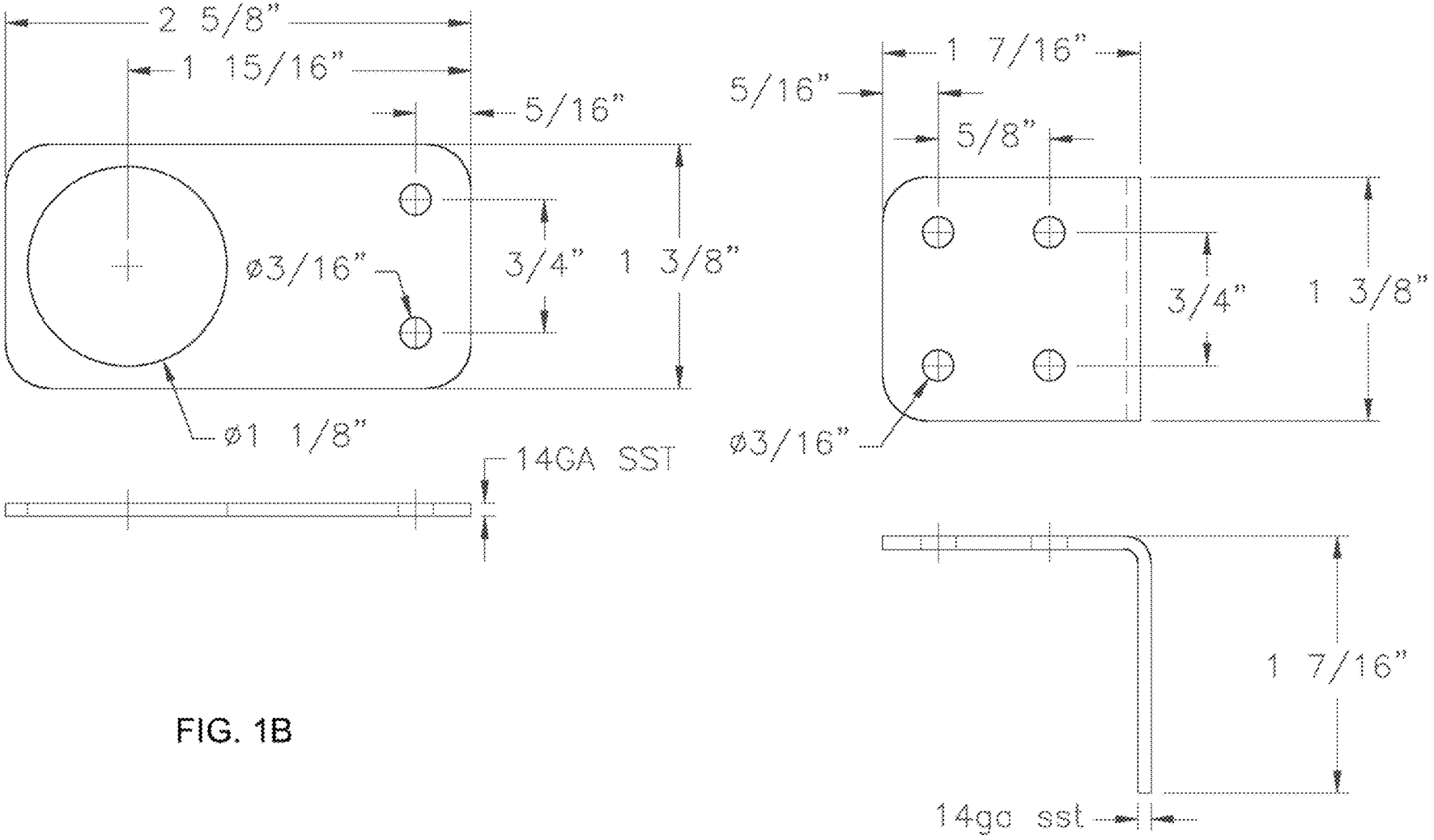
FIG. 1B is an engineering diagram showing distances in an embodiment.

Flat plate 14 can have various lengths and widths. In one embodiment, the length is 3.25 inches and the width is 1⅜ inches. In another embodiment, the length is 2⅝ inches. In one embodiment, the distance between the center of recess opening 28 and top 16*a* of flat plate 14 is 1 15/16 inches and the distance between center of recess opening 28 and center of first set of fastener openings is 1⅝. This is demonstrated in FIG. 1B. For the smaller recess opening 28 for recessed magazine caps, the outer edge of recess and top 16*a* of flat plate 14 is approximately ½ inch. As shown in FIG. 1, in many embodiments, flat plate 14 has rounded edges on top 16*a*. In yet other embodiments, top 16*a* is in the shape of a semi-circle. In other embodiments, flat plate 14 is rectangular.

Figure 3:
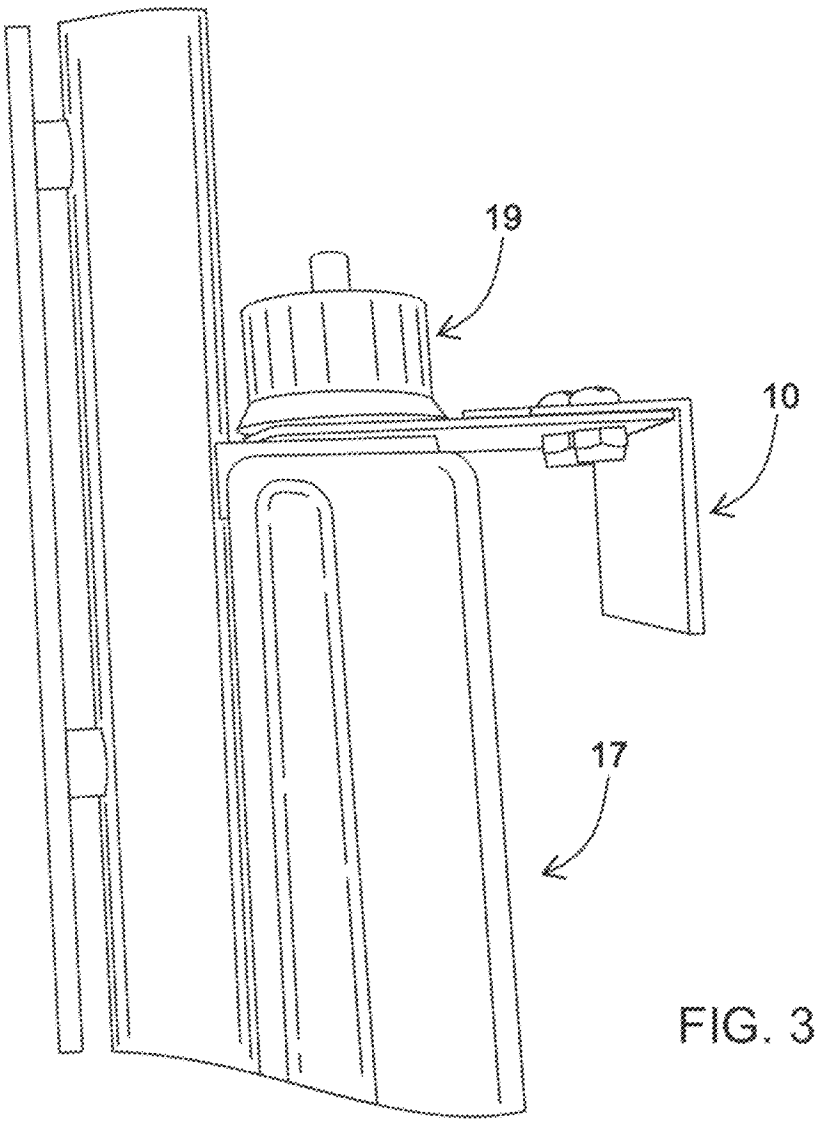
FIG. 3 is a perspective view of the gun hanger in position on a firearm.
Figure 4:
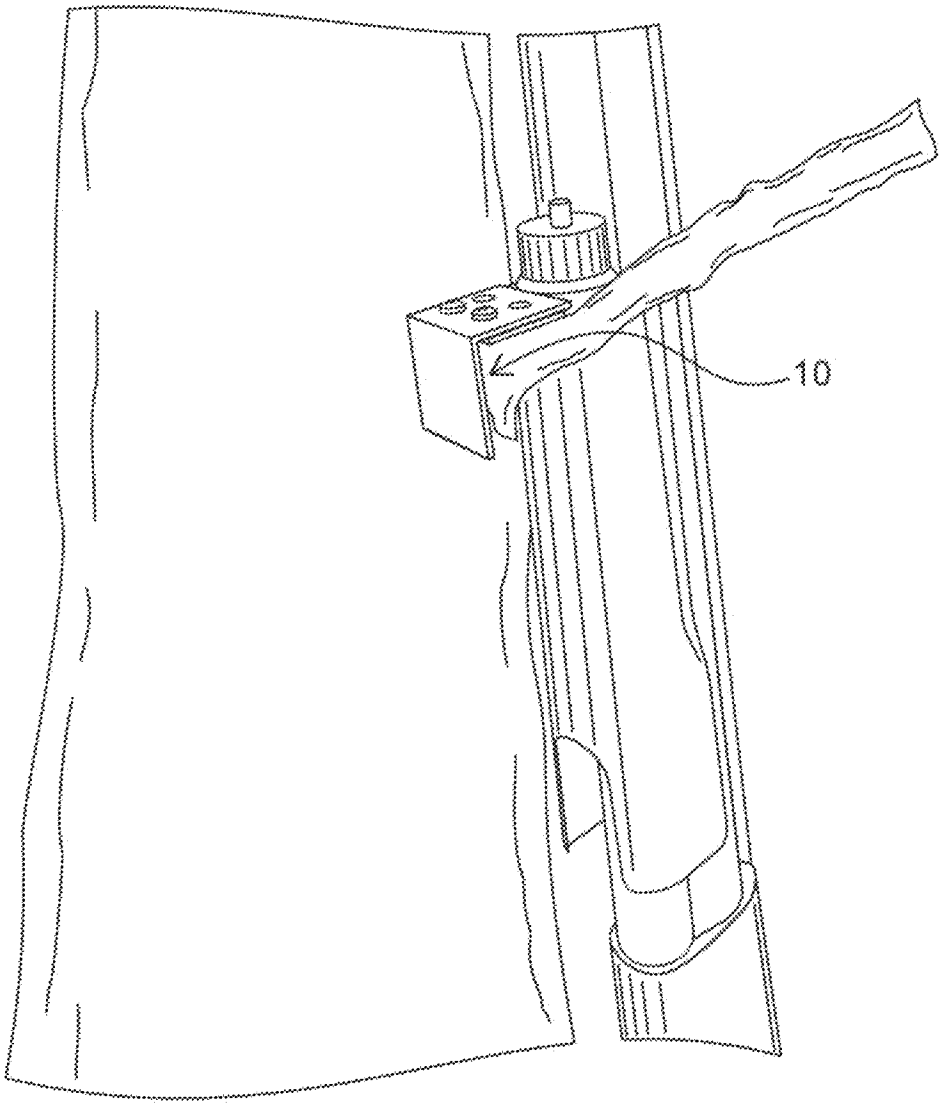
FIG. 4 is a perspective view of the gun hanger in use on a branch.
Figure 5:
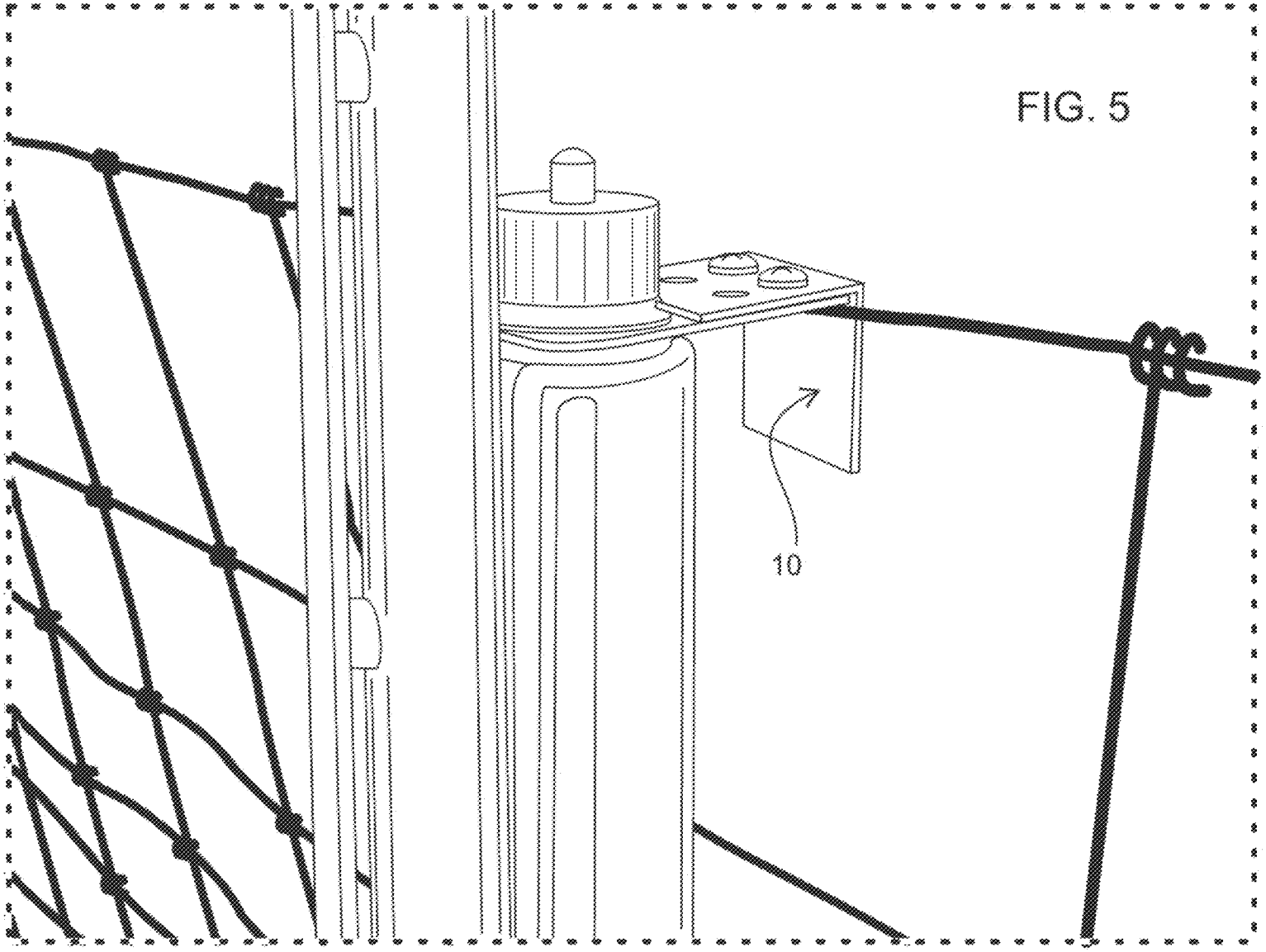
FIG. 5 is a perspective view of the gun hanger in use on a fence.

L-shaped member 12 is not meant to be limiting. L-shaped member 12 must be long enough to support a firearm with gun hanger 10 attached in the vertical position on a supporting element. In one embodiment, L-shaped member 12 is 1.5 inches in length in both directions. In another embodiment, shaped position is 1 7/16 in length in both directions. FIG. 3 demonstrates gun hanger 10 in position on a firearm with magazine 17 and magazine cap 19. As demonstrated by FIGS. 3-5, this allows for firearm 15 to be disposed in a vertical position by engaging hanger 10 with a supporting element, for example, a branch (FIG. 4) or a fence (FIG. 5). And although FIGS. 4 and 5 show specific supports, hanger 10 can be engaged to support the firearm with most types of horizontal members, hooks, or the like, thus facilitating the hanging of the firearm in any convenient location as desired. For example, gun hanger 10 can be used with commercially available hunting hooks that attach to trees.

If hanger 10 is formed from two pieces, there is no requirement that L-shaped member 12 and flat plate 14 be the same material, same width, or same material thickness. However, in many cases, they will be made from the same material and generally be the same width and thickness. In one embodiment, the width of both L-shaped member 12 and top plate 14 is 1⅜ inches. Gun hanger 10 may be made from material such as plastic or rubber. In one embodiment, gun hanger 10 is aluminum. In another embodiment, gun hanger 10 is casted metal. Thickness can vary. In one embodiment, gun hanger 10 is uniformly ⅛ inch thick. In another embodiment, gun hanger 10 is 0.25 inches thick. In yet another embodiment, gun hanger 10 is 0.5 inches thick. The skilled artisan understands that the thickness of the gun hanger may change depending on the material used. In one embodiment, the material will be 14 gauge stainless steel. In some embodiments, the material of gun hanger 10 provides a tensile strength of more than 500 pounds.

Figure 6:
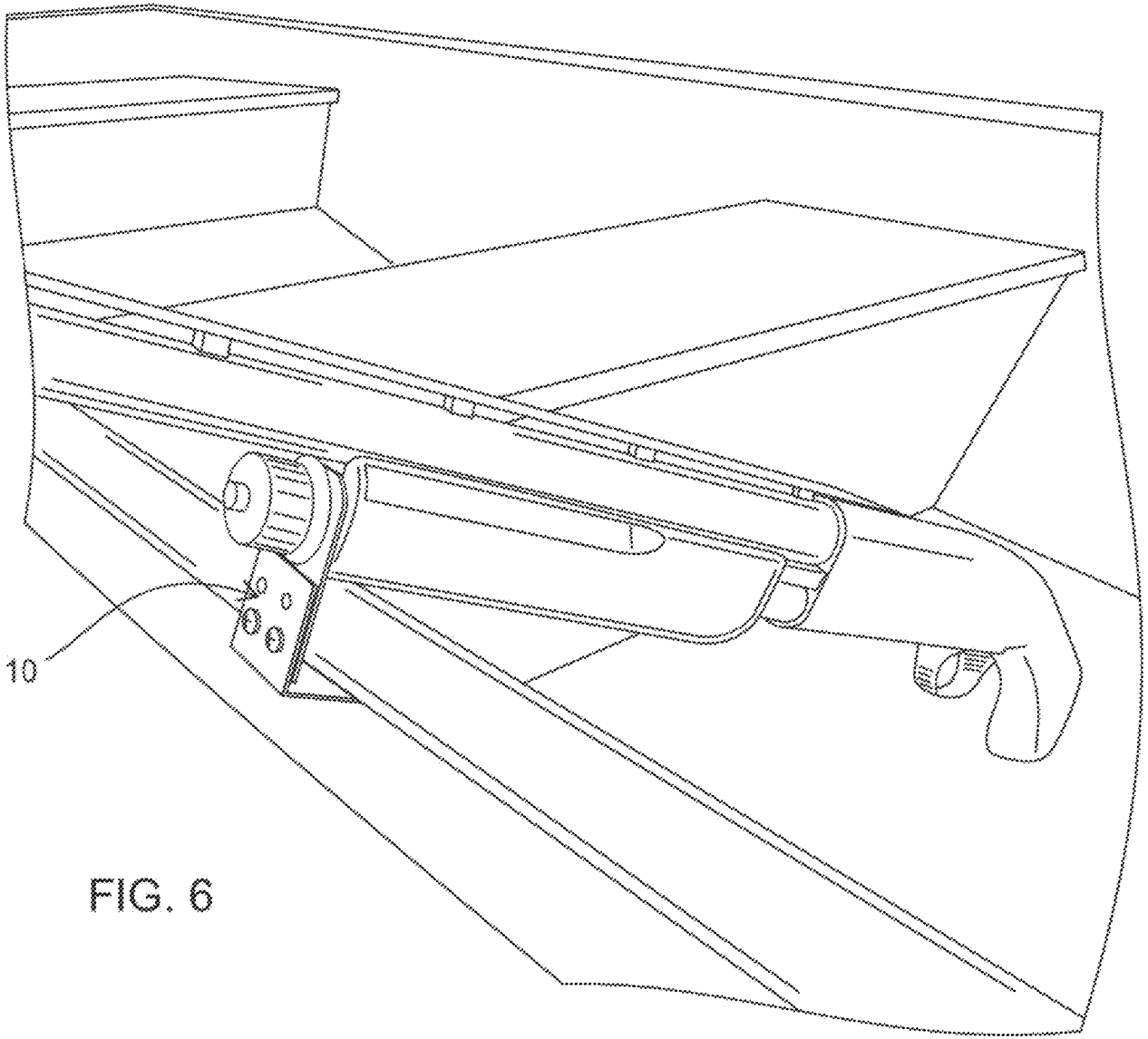
FIG. 6 is a view of the gun hanger in use on a boat with a duck blind.

Gun hanger 10 can also be used to rest the firearm at an advantageous angle, such as that shown by FIG. 6. For example, when attached to a duck blind attached to a boat, gun hanger 10 can prevent the firearm from being able to slide and potentially disengage and discharge.

Gun hanger 10 is designed for use with firearms in the field, i.e. when the firearm is being used to hunt. Hanger 10 allows a user to hang the gun in a safe vertical position while being able to use both hands. It allows a user to be able to move about while the gun is safely secured. An example of where this would be advantageous is if the gun user needs to climb over or through a fence. Securing the firearm while it is not in use eliminates the very real hazards of accidentally dropping the gun and causing injury. Due to the nature of gun hanger 10, the gun may be readily removed from the support, thus providing a measure of safety when desired in certain circumstances. In some situations, gun hanger 10 is used to lift a firearm up, such as to a tree stand. Furthermore, not only is the disclosed hanger easy to attach and detach as well as small in size to carry and durable, fits on the firearm when it is in a standard gun case, and due to its simple construction, it can be readily and easily manufactured at low cost and from materials which are readily available.

Although only exemplary embodiments have been described above and in the figures, those skilled in the art will readily appreciate that many modifications are possible without materially departing from the novel teachings and advantages of the disclosed device. The present embodiments are therefore to be considered in all respects as illustrative and not restrictive.

The invention claimed is:

1. A gun hanger, adapted to hang a firearm in a vertical position comprising:

an L-shaped member, the L-shaped member having a top, a top side, a bottom side, and a bottom, wherein the bottom side of the L-shaped member is disposed to engage a corresponding top side of a flat plate, yet further wherein the L-shaped member has at least four fastener holes; and a flat plate having a top, a top side, a bottom side, a bottom, and a recess, and at least four fastener holes, wherein the recess is adapted to receive a firearm magazine;

wherein the bottom side of the L-shaped member is releasably connected to the top side of the flat plate such that a fastener can be placed into the fastener holes such that a respective distance from the top of L-shaped member and the top of the flat plate can be adjusted.

2. The gun hanger of claim 1 wherein the L-shaped member is 1 7/16 inches by 1 7/16 inches in length.

3. The gun hanger of claim 1 wherein the flat plate is 2⅝ inches in length.

4. The gun hanger of claim 1 wherein the recess is about a 1⅛ inch diameter recess.

5. The gun hanger of claim 1 wherein the recess is about a ¾ inch diameter.

6. The gun hanger of claim 1 wherein the recess is between about ¾ inch diameter and 1⅛ inch diameter.

7. The gun hanger of claim 1 wherein the recess is about a ¼ inch diameter.

8. The gun hanger of claim 1 wherein the L-shaped member is releasably connected to the flat plate by at least two screws and at least two nuts.

9. The gun hanger of claim 8 wherein the at least two screws have choke tube tool heads.

10. The gun hanger of claim 1 wherein the L-shaped member and the flat plate are stainless steel.

11. The gun hanger of claim 1 wherein the flat plate has a rounded top.

12. The gun hanger of claim 1 wherein the gun hanger is secured between a firearm magazine and a magazine cap.

13. A method for hanging a firearm vertically comprising the steps of:

removing a firearm magazine cap from a firearm magazine;

attaching a gun hanger to the firearm magazine, wherein the gun hanger comprises:

a L-shaped member, the L-shaped member having a top, a side, and a bottom, wherein the L-shaped member is disposed to engage a corresponding bottom of a flat plate and a support, yet further wherein the L-shaped member has fastener holes; and a flat plate having a top, a side, a bottom, and a recess, wherein the recess is adapted to receive a firearm magazine;

wherein in the bottom side of the L-shaped member is releasably connected to the top side of the flat plate such that a fastener can be placed into the fastener holes such that a respective distance from the top of L-shaped member and the top of the flat plate can be adjusted;

screwing the firearm magazine cap on the firearm magazine to secure the gun hanger; and hanging the firearm on a support.

14. The method of claim 13 wherein the recess is about a 1⅛ inch diameter.

15. The method of claim 14 wherein the recess is about a ¾ inch diameter.

16. The method of claim 14 wherein the recess is between about ¾ inch diameter and 1⅛ inch diameter.

17. A method of safely handling a gun comprising:

attaching a gun hanger to a firearm, wherein the gun hanger comprises:

a L-shaped member, the L-shaped member having a top, a side, and a bottom, wherein the L-shaped member is disposed to engage a corresponding bottom of a flat plate and a support, yet further wherein the L-shaped member has fastener holes; and a flat plate having a top, a side, a bottom, and a recess, wherein the recess is adapted to receive a firearm magazine;

wherein the bottom side of the L-shaped member is releasably connected to the top side of the flat plate such that a fastener can be placed into the fastener holes such that a respective distance from the top of L-shaped member and the top of the flat plate can be adjusted; and hanging the firearm in a vertical position on a support.

* * * * *